US005441677A

United States Patent [19]

Phillips, Sr.

[11] Patent Number: 5,441,677

[45] Date of Patent: Aug. 15, 1995

[54] METHOD OF MAKING HIGH GLOSS, HARDENED CONCRETE FLOORS

[75] Inventor: David L. Phillips, Sr., Prior Lake, Minn.

[73] Assignee: Hi-Tech Floors, Inc., Burnsville, Minn.

[21] Appl. No.: 115,882

[22] Filed: Sep. 1, 1993

[51] Int. Cl.[6] ..... B28B 1/16; B28B 1/48; E04B 1/16

[52] U.S. Cl. ..... 264/31; 264/34; 264/35; 264/133; 264/154; 264/162; 264/163; 264/256; 264/308; 264/DIG. 43

[58] Field of Search ..... 264/31–36, 264/162, 163, 256, 310, DIG. 43, 154, 133, 308

[56] References Cited

U.S. PATENT DOCUMENTS

| | | | |
|---|---|---|---|
| 1,314,810 | 9/1919 | Johnson | 264/DIG. 43 |
| 1,515,121 | 11/1924 | Kaufman . | |
| 1,605,197 | 11/1926 | Anfield | 264/34 |
| 1,942,000 | 7/1931 | Reynolds . | |
| 1,949,876 | 3/1934 | Plauson | 264/31 |
| 2,078,289 | 4/1937 | Sloan . | |
| 2,143,515 | 1/1939 | Hayden | 264/31 |
| 2,275,272 | 3/1942 | Scripture, Jr. . | |
| 2,277,203 | 3/1942 | Boult . | |
| 2,344,578 | 3/1944 | Whitesides . | |
| 2,853,928 | 9/1958 | Reardon . | |
| 2,963,765 | 12/1960 | Tillman . | |
| 3,386,854 | 6/1968 | Sautier . | |
| 3,392,222 | 7/1968 | Cordon . | |
| 3,502,500 | 3/1970 | Hoock . | |
| 3,589,917 | 6/1971 | Hedlund . | |
| 4,281,496 | 8/1981 | Danielsson . | |
| 4,740,348 | 4/1988 | Rose | 264/31 |
| 4,748,788 | 6/1988 | Shaw et al. . | |
| 4,769,201 | 9/1988 | Chiuminatta et al. | 264/163 X |
| 4,889,675 | 12/1989 | Chiuminatta et al. | 264/163 X |

FOREIGN PATENT DOCUMENTS 2111897 7/1983 United Kingdom .

OTHER PUBLICATIONS

"Guide for Concrete Floor and Slab Construction", American Concrete Institute, Detroit, Mich., First Printing Mar. 1990, Copyright 1989, pp. 302.1R-1-44.

*Primary Examiner*—Karen Aftergut
*Attorney, Agent, or Firm*—Haugen and Nikolai

[57] ABSTRACT

A method of fabricating a concrete floor having an autogenous hard high gloss finish that does not require further coatings includes pouring a designed concrete mix to establish a slab having an upper surface slightly below the level determined for the finished floor. A finishing floor surface layer is created by applying an amount of a dry shake dressing material containing quartz crystals and a coloring agent, but no coarse aggregate, to the upper surface of the slab and floating the surface until the finishing layer reaches predetermined amount which cures to form a generally monolithic structure with the slab but having a higher compressive strength when fully cured. Necessary expansion joints are provided. The floor is coated with a curing sealer and allowed to cure for approximately 30 days, or until it reaches a predetermined compressive strength. The sealer material is removed and the expansion joints are sealed. The upper surface is then mechanically sanded and polished until a predetermined level of shine or gloss is achieved in the floor surface layer itself.

21 Claims, 1 Drawing Sheet

METHOD OF MAKING HIGH GLOSS, HARDENED CONCRETE FLOORS

BACKGROUND OF THE INVENTION

I. Field of the Invention

The present invention is directed generally to improvements in concrete flooring and, is more particularly directed to improving the qualities of the floor surface related to appearance, durability, safety and reduction of maintenance requirements. The invention is particularly suited to high-traffic concrete floors such as those found in retail warehouse-type establishments.

II. Discussion of Related Art

Retail establishments have unique flooring demands. The floors and floor surfaces must deal with heavy loading, impacts from dropped articles and high traffic which, with other factors, combine to make it extremely difficult for the flooring industry to satisfy the needs of the retailer at a reasonable total cost, i.e., considering both installation and maintenance costs. Conventional retail floor systems of the class of interest normally consist of a slab of conventional load-bearing reinforced concrete covered by vinyl tile or a thin layer of marble or other stone chips set in mortar and polished (terrazzo). These combinations of materials, however, are prone to chipping, cracking and wear resulting in significant on-going repair and including frequent down time and, eventually, costly replacement.

These traditional floor systems require frequent work to sustain an attractive appearance. The maintenance costs of cleaning, waxing and buffing the floor surface may surpass the total cost of the original floor in as short a period as 2 years. In addition, some wax stripping solutions and other surface treating materials may pose environmental hazards and create significant disposal problems. Even with such continual maintenance, waxed floors, over time, tend to yellow and show wear from foot and wheel traffic. A dull appearance further adversely affects lighting levels and overall product presentation in, for example, retail space. Worn and damaged tiles can also result in an unsightly appearance and added safety concerns. Conventional floor surfaces present a danger that customers and employees alike will slip and be injured on wet or waxed floors and the use of these conventional types of floor surfaces may carry higher insurance premiums to the retailer.

In the related art, diverse attempts have been made to control and modify the characteristics including the surface characteristics of concrete flooring, road beds or the like. U.S. Pat. No. 4,746,788, to Shaw et al discloses a process for producing a concrete surface of seeded exposed aggregate using small, rounded aggregate (preferably sand) which is broadcast over the upper surface of the pour and thereafter mixed into the cement paste of the concrete pour matrix. A surface retarder and vapor barrier is applied for a short-term (approximately 4 to 24 hours) and removed and the concrete is thereafter cured by fogging or with a soaker hose and, after approximately 30 days, the surface residue is removed with a steam/acid wash to expose the finished floor. Another method of producing a sand/cement upper surface is disclosed in U.S. Pat. No. 4,281,496, to Danielsson in which larger aggregate is allowed to settle, producing a thin upper layer formed substantially of sanded cement which is thereafter floated to remove surface irregularities. After curing 1 to 5 days, the upper surface is treated in a grinding operation to produce a flat, porous surface having a sanded quality.

Another earlier technique involves the application of an excessively dry top dressing mix while the concrete base is still wet. Water rising from the base concrete penetrates into the topping and the two bond together. The top stratum of the conglomerate can then be wetted and floated to achieve a smooth finish. Such a system is shown by Sloan in U.S. Pat. No. 2,078,289. Reardon, in U.S. Pat. No. 2,853,928, discloses a method for curing concrete in which a dry powder composition is spread over the top of the wet concrete to absorb the excess moisture. The dry powder, however, is not blended into the concrete base and after the concrete is cured for a sufficient length of time, the dry powder is removed by vacuuming or sweeping. That composition is approximately 80 parts silica ($SiO_2$) and about 20 parts salt (NaCl).

A further patent to Boult (U.S. Pat. No. 2,277,203) discloses yet another technique in which a hardening agent is applied to the surface of a foundation or lower concrete layer which combines with the gauging water or liquid of the foundation layer and a dry ingredient topping of cement and granite or other chips (terrazzo) is applied to the treated surface. The general effect produces a graduated hardening decreasing from the exposed surface of the topping layer downward through that layer and into the upper portions of the foundation layer to produce a hard, wear-resistant upper surface in a monolithic construction.

It is further known to apply a dry shake into a concrete base to control the concrete surface moisture. The dry shake may be incorporated to produce a monolithic cementitious floor by using various processes. None of these prior techniques, however, have resulted in floors having the desired combination of appearance and durability.

From the above, it is apparent that diverse problems confront those who would create more ideal retail or other high-traffic floor systems. One significant goal is to enhance the long-term durability such that the floor system will stand up to many years of daily traffic and the impact of dropped items or the like. In addition, improvements that reduce maintenance costs without sacrificing appearance are of paramount interest. A floor surface able to retain a high gloss finish without the need for additional surface treatment, such as waxing, would be highly desirable. In addition, for safety reasons, it is desirable that the slipperiness of the floor surface be reduced in both the wet and dry conditions. This is true for the safety of customers and employees alike. Thus, a durable, highly reflective or even colored floor of reduced slipperiness which does not require waxing and which maintains a high surface luster to brighten the shopping environment is highly desirable.

While each of the above-enumerated prior patents or other techniques discloses attempts to improve surface characteristics of cement flooring construction, none achieves a combination of improvements which address most or all of the needed improvements.

SUMMARY OF THE INVENTION

By means of the present invention, an improved cementitious floor and a process for fabricating an improved cementitious floor have been developed that address and solve problems associated with prior floors, especially floors addressing the high performance and aesthetic requirements of retail establishments. The process of the present invention provides a practical unique monolithic cementitious floor surface which is characterized by a high gloss finish and a full cure surface hardness in excess of 10,000 pounds per square inch (psi) (700 kg/cm$^2$). The surface requires no wax to maintain its surface gloss or integrity and can be maintained with simple soap and water cleaning techniques. The process results in a floor with reduced slipperiness in both the dry and wet conditions.

The process begins with a cement pour over an area prepared in the normal manner with respect to site preparation and utilizing the normal reinforcing rod or mesh and other components laid on a sand base. The pour is made utilizing a design or custom mix of concrete selected from a preferred range of mixes of the following approximate composition:

1. 360–675 (~160–310 kg) pounds type one cement;
2. 1000–1800 pounds (~450–820 kg) fine aggregate SSD;
3. 1300–2500 pounds (~590–1140 kg) gravel course aggregate number 8;
4. 8–14 ounces (~225–400 g) of a water reducer;
5. 175–320 pounds (~80–150 kg) of water adjusted to provide a three-inch (~7.5 cm) slump plus or minus one-half inch (~1.3 cm); and
6. 11–21 ounces (~310–600 g) of a plasticizer which may be adjusted to produce a slump factor of about 5.

With respect to the materials themselves, SSD refers to Saturated Surface Dry which is a well-known term respecting the water content of the aggregate added to the mix. The water reducer 220N is one of many generic forms of additive products that can be used to reduce the relative amount of water needed or water ratio thereby minimizing slump and maximizing cured concrete strength. The water reducer is typically essentially made of corn syrup or corn starch and is sometimes described as a polyhydroxilated polymer. One preferred material is known as Master Builders water reducer 220N.

With regard to the plasticizer, plasticizers are generic materials, containing ingredients such as calcium napthalene, which are usually added in conjunction with a water reducer to adjust the consistency of the concrete or the slump factor by raising it to the desired ratio and one such material which may be used in the present invention is known as Master Builders Rheo build super plasticizer. It should be noted that 220N and Rheo are trademarks of Master Builders, Inc., Cleveland, Ohio.

After the base has been properly prepared, the designed concrete mix is prepared and the consistency adjusted. The pour is made and the concrete distributed over the pour area. A level approximately 0.5 inch (~1.3 cm) below grade is established by a vibrating mechanical screed or the like over the pour area, typically 40 feet (~12 m) in width. Immediately after the level is established by the screed level, the concrete may be further finished utilizing a wood surfacing or float tool. After floating, applications are made of a dry shake product such as Master Builder Colorcron®, which is a mixture of Portland cement, silicon and crystalline quartz, optionally containing a color pigment, and the entire surface is, again, finished by floating to the desired texture. This process is repeated until the surface is firm enough to support a finishing blade. At this point, the float blades are removed and the surface is finished utilizing the mechanical troweling machine without the float blades an additional amount (1 to 4 times) until finished texture is achieved. The final surface is then inspected and finished by hand utilizing a steel trowel. Upon the conclusion of this initial or precure finishing, the entire surface is covered with a water soluble sealer, which may be a water-based wax emulsion such as Master Builders Masterkure 200®.

The finished, sealed pour is allowed to cure, normally overnight, or until it has sufficient strength such that a cutting and filling operation can be performed to provide expansion joints. The surface is cross-hatched utilizing a concrete saw creating expansion joints, nominally about one fourth of the slab thickness in depth and about 3/16 inch (~0.5 cm) in width 12 feet (~3.7 m) or less on center.

The floor at this stage of preparation is allowed to cure for approximately 30 days or until the concrete reaches its substantially full compressive strength of approximately 4,000 psi (~280 kg/cm$^2$). The seal prevents bleeding of the water contained in the mix during the cure.

Once the slab is cured, the expansion cuts are provided with gasket material in the form of polymeric rods or tubes inserted and compressed into the cuts, leaving space above for a sealing material. The gasket material is typically polyolefin material such as polyethylene or polypropylene but other materials such as polystyrene can be used. The rods or tubing are generally somewhat larger in diameter than the crack width so that a forced, tight fit is provided. The open portion of the joint cuts above the gasket material is filled with a resilient polymeric filling/sealing material, such as an epoxy resin, which can be colored to any desired hue or tint by the addition of color pigment. One such epoxy resin product with color pigment added is known as Master Builders Masterfill CJ®. The filler fills and resiliently seals the top portion of the cut opening, thereby preserving continuity of the top seal.

The seal is then removed with a motorized floor buffing machine equipped with hardened brushes (carbon steel) which remove the sealer and perform initial buffing of the monolithic surface. Based on an evaluation of the surface smoothness, the surface is next sanded with progressively finer sanding screen disks, usually 60, 80, 100 and possibly 120, etc. grit sanding screen disks, to establish the final desired surface smoothness. A final luster or gloss is achieved utilizing a polymer brush (preferably polyurethane) with water to perform the final surface cleaning and this step may be repeated until the desired level of shine has been achieved.

It is preferred that the entire pouring, finishing and curing process be conducted in an ambient temperature between approximately 55° F. (~13° C.) and 85° F. (~30° C.). The final buffing and shining operation utilizing the polymer brush is normally carried out at a time just prior to the anticipated use of the floor. The shake blended floor surface continues to cure and gain strength until the compressive strength of the surface layer exceeds 10,000 psi (~700 kg/cm$^2$). This compares with a maximum of about 4,000 psi (~280 kg/cm$^2$) for plain concrete or a terrazzo surface, for example.

BRIEF DESCRIPTION OF THE DRAWINGS

In the drawings, wherein like numerals depict like parts throughout the same.

DETAILED DESCRIPTION

In accordance with the present invention, there is produced a highly reflective floor surface that will brighten the shopping environment and complement any type of retail decorating. The floor is characterized by a tight, dense, high strength, hardened surface with uniform color and texture making it difficult for liquids, dirt and grime to penetrate. The unique finish of the surface hardener is achieved through product formula characteristics and an unique process of in situ fabrication which includes special techniques of dry shake application, floating, finishing, cutting and joint filling, curing and polishing.

Figure 1:
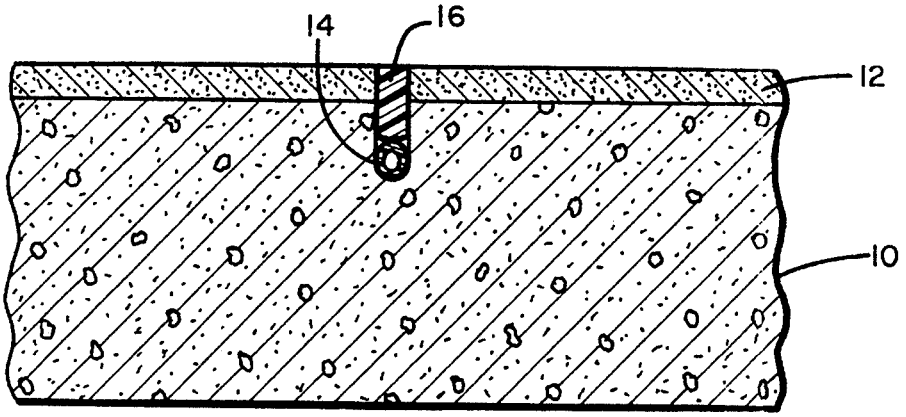
FIG. 1 is a fragmentary crossectional elevation view through a typical concrete slab utilizing the top layer of the invention.

As can be seen in the fragmentary crossectional view of FIG. 1, the concrete floor in accordance with the invention includes a rather thick layer of a designed mix of concrete 10 topped by a relatively thin finishing layer 12 which merge together to create a monolithic structure. A typical expansion joint is shown cut in at 14 containing a cured resilient polymeric filler 16 which seals the joint and prevents extraneous material from collecting and interfering with the operation of the expansion joint itself.

Figure 2:
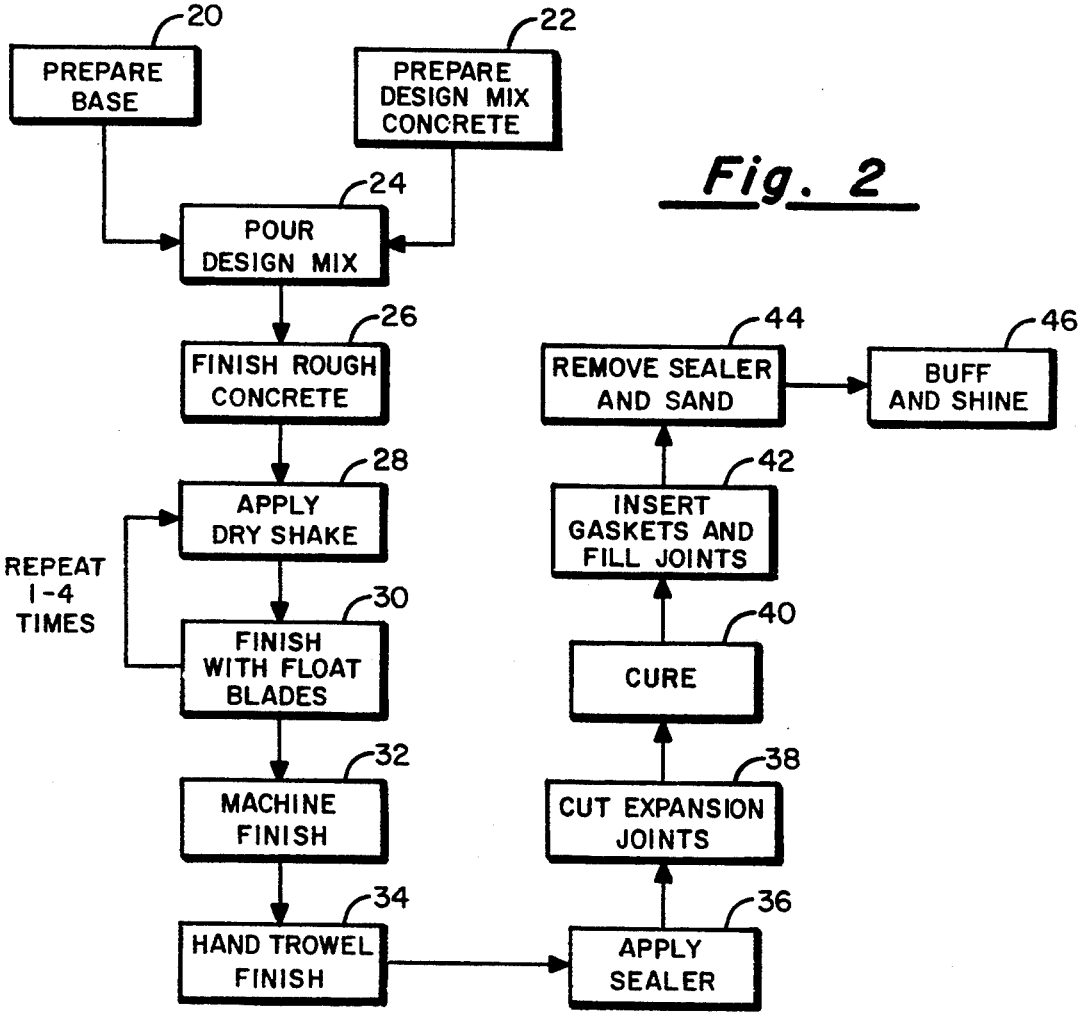
FIG. 2 is a block diagram showing the steps in the preferred process for producing the concrete slab of FIG. 1.

FIG. 2 depicts steps in a preferred process or method of fabricating the monolithic composite concrete slab of FIG. 1. The method and floors of the invention begin with conventional base and form preparation at 20. As with any concrete floor, the base must be of a composition and firmness to properly float the slab. Mesh or reinforcing rod are placed in the forms as desired. The basic or main concrete layer 10 is poured at 24 utilizing a designed mix of materials prepared at 22 and including cement, aggregate, water reducer and plasticizer, blended together in a mixer utilizing ingredient proportions substantially within the following range of compositions:

1. 360–675 pounds (~160–310 kg) type one cement;
2. 1000–1800 pounds (~450–820 kg) fine aggregate SSD;
3. 1300–2500 pounds (~590–1140 kg) gravel course aggregate number 8;
4. 8–14 ounces (~225–400 g) of a water reducer material, which may be Master Builders water reducer 220N;
5. 175–320 pounds (~80–150 kg) of water adjusted to provide a three-inch (~7.5 cm) slump plus or minus one-half inch (~1.3 cm); and
6. 11–21 ounces (~310–600 g) of a plasticizer (such as Master Builders Rheo build super plasticizer) adjusted to produce a slump factor of about 5.

It is contemplated that the final use of the floor and other considerations will enter into the determination of the particular composition of the floor for a given application, particularly within the above ranges. The compositions given herein are given by way of examples and not intended as specific limitations. Within this range, one particular mix, which has been used with a high degree of success, has the following approximate composition:

1. 517 pounds (~235 kg) type one cement;
2. 1400 pounds (~635 kg) fine aggregate SSD;
3. 1900 pounds (~860 kg) gravel course aggregate number 8;
4. 11 ounces (~310 g) of the Master Builders 220N or equivalent water reducer;
5. 247 pounds (~112 kg) of water adjusted to provide a three-inch slump plus or minus one-half inch (~1.3 cm); and
6. 16 ounces (~450 g) of plasticizer (Master Builders Rheo build super plasticizer or equivalent) adjusted to provide a slump factor of about 5.

It will be appreciated that the consistency is a very important consideration in the mix and excess moisture or too little or too much slump are undesirable conditions that need to be addressed and corrected in the mix prior to pouring. Consistency and total available moisture control the success of the dry shake overlayer and the cure.

After the design mix has been prepared and checked at 22 (FIG. 2), the mix is poured in conventional fashion at 24 over the pour area of the base and the concrete is distributed preferably to a level approximately 0.5 inch (~1.3 cm) below the desired grade. The level is established utilizing a vibrating mechanical screed or other conventional concrete distributing device operated over the pour area which is typically up to about 40 feet (~12 m) in width and as long as desired inasmuch as this is a convenient size to process at once. A complete floor may consist of many separately processed pour areas combined to form a larger floor area. After the proper level is established by the screed or other device, the concrete may be further finished at 26 utilizing a wood surfacing or float tool to accomplish an initial rough finish to the concrete.

After the floating operation is completed, the dry shake is applied and floated at 28, 30. This may be accomplished in a number of ways. In one process, application of approximately 1.0 lb/ft$^2$ (~0.5 g/cm$^2$) are made utilizing a dry shake product such as Master Builder Colorcron®. After application of the dry shake material, the surface is finished using a mechanical troweling machine having attached float blades (floated) and the entire surface is again finished by floating. After the initial floating operation, an additional approximately 0.5 lb/ft$^2$ (~0.25 g/cm$^2$) of dry shake is applied and the entire surface is again floated to the desired texture. This operation is thereafter repeated using increments of approximately 0.5 lb/ft$^2$ (~0.25 g/cm$^2$) until a uniform color is achieved. At this point, the floor has been floated typically anywhere from 4 to 8 times and contains typically from about 1½ to 2½ lb/ft$^2$ (~0.8 to ~1.2 g/cm$^2$) of dry shake material.

The float blades are removed and the surface is finished utilizing a mechanical troweling machine at 32 in which sufficient passes are made until the desired finished texture is achieved. This is normally accomplished in approximately 1 to 4 passes. The final surface is then inspected and finer finishing applied by hand utilizing steel trowel techniques as at 34 makes the surface suitable for curing. Upon the conclusion of this initial or pre-cure finishing, the entire surface is coated with a water soluble sealer material, which may be a water-based wax emulsion such as Master Builders Master Kure 200® at 36.

The finished, sealed floor is then allowed to cure for a period of hours, usually overnight, or until it has sufficient strength such that a cutting operation 38 can be performed to provide expansion joints in the poured slab. The surface is cross-hatched using a conventional concrete saw which, depending on the thickness of the slab, provides cuts approximately one fourth of the thickness of the slab in depth and approximately 3–16 inch (~0.5 cm) in width 12 feet (~3.7 m) or less on centers over the entire slab.

The floor at this stage of preparation is in a state where the surface is fairly smooth and sealed and is thereafter allowed to cure for approximately 30 days at 40 or until the concrete reaches a compressive strength of approximately 4,000 psi (~280 kg/cm$^2$). As is the case with the initial pour and finishing, the ideal curing temperature for the concrete is in the range of 55° F. (~13° C.) to 85° F. (~30° C.). It is further recognized that the layers of top dressing, together with the original formulation, have been completed contemplating a sealed cure. This is further confirmed by careful checks of the slump and slump factors during preparation of the designed concrete mix. The water soluble seal overlayer further prevents bleeding of any water contained in the mix during the cure. The amount of water in the sealed curing concrete is generally designed to maximize cured compressive strength.

After the 30-day cure is complete or at such time as the concrete is determined to have reached the desired compressive strength, the expansion cuts are provided with gasket material in the form of polymeric rods or tubes inserted and pressed into the cuts a distance below the surface. The gasket material is typically made from polyolefin material such as polyethylene or polypropylene, but other materials such as polystyrene can be used. The rods or tubing are generally somewhat larger in diameter than the crack width so that a forced, tight fit is provided. The open portion of the joint or upper portion of the cuts above the gasket material is filled with a resilient polymeric filler material, such as an epoxy, which can be colored to any desired hue or tint. The filler occupies and resiliently seals the top portion of the cut opening, thereby preserving continuity of the top seal at 42.

The water soluble sealing material is then removed at 44 as with a motorized floor buffing machine, preferably equipped with carbon steel hardened brushes which not only remove the sealer but also perform an amount of initial buffing of the monolithic surface. Based on a case-by-case evaluation, the surface is further smoothed by sanding with progressively finer sanding screen disks, for example, 60, 80, 100, 120, etc. grit sanding disks, to establish the final desired surface smoothness. A high-speed buffer equipped with a polymer brush, preferably polyurethylene, is used with water to do the final surface cleaning and achieve a final permanent luster or gloss to the floor surface. This polishing can be continued until the desired level of shine has been achieved. The final buffing and shining operation 46 is normally carried out at a time just prior to the anticipated use of the floor.

An important consideration with respect to the composite floor system of the invention is that the dry shake layers applied over the initial pour and as thereafter processed become incorporated in the pour to produce a generally monolithic concrete structure. The dry shake or top dressing layers, of course, do not contain the larger aggregate generally dispersed throughout the designed concrete pour mix. Even as these processes are carried out and including the final sanding and polishing, the floor surface layer continues to cure and gain compressive strength until the compressive strength exceeds 10,000 psi (~700 kg/cm$^2$). The under slab typically has a cured compressive strength of about 4,000 psi (~280 kg/cm$^2$), comparable to, as noted above, the maximum strength of the surface of terrazzo floors. The surface of the floor produced in accordance with the present invention is also extremely hard and difficult to damage. The surface can be polished to a permanent luster competitive with waxed floors, which can be maintained by reshining only at rather lengthy intervals.

For all its luster and shine, however, it will be noted that sufficient surface grit still remains to provide traction superior to dry waxed floors in either the dry or wet state. The floor can be maintained utilizing conventional soap and water cleaning techniques.

This invention has been described in this application in considerable detail in order to comply with the Patent Statutes and to provide those skilled in the art with the information needed to apply the novel principles and to construct and use such specialized components as are required. However, it is to be further understood that the invention can be carried out by specifically different equipment and devices and that various modifications both as to equipment and procedure details can be accomplished without departing from the scope of the invention itself.

For example, the Master Builders water reducer 220N can be replaced with any suitable concrete water reducer in an amount which could readily be determined. Also, the plasticizer used may be any suitable plasticizer material which will perform the same function with the amount adjusted in like manner.

I claim:

1. A method of fabricating a concrete floor having a very hard, autogenous, high gloss surface finish comprising the steps of:

(a) pouring a specifically formulated design concrete mix containing coarse aggregate to establish a poured slab of a predetermined slab thickness having an upper surface and an upper surface distributed level slightly below a level determined for the finished floor;

(b) creating a floor surface layer on said upper surface of said slab by applying an amount of dry shake dressing material having no coarse aggregate, to said upper surface and floating said dry shake dressing material on said upper surface until a predetermined amount of dry shake dressing material is applied, such that said floor surface layer forms a generally monolithic floor with the concrete of said poured slab upon curing but which floor surface layer has a higher compressive strength than a compressive strength of said concrete of said slab when fully cured;

(c) optionally applying additional mechanical finishing until a predetermined cure finish texture is achieved;

(d) applying a coat of sealer material over said upper surface;

(e) cutting in necessary expansion joints at predetermined intervals prior to allowing said floor to cure;

(f) allowing said floor to cure approximately 30 days or until it reaches a predetermined compressive strength;

(g) applying sealing material in said expansion joints prior to finishing said floor surface layer;

(h) removing said coat of sealer material;

(i) mechanically further reducing surface roughness by sanding said floor surface layer; and (j) polishing the surface of said floor surface layer until a final level of floor shine is achieved.

2. The method of claim 1 wherein the specifically formulated design concrete mix comprises:

i. 360–675 pounds type one cement;
ii. 1000–1800 pounds fine aggregate SSD;
iii. 1300–2500 pounds gravel coarse aggregate number 8;
iv. 8–14 ounces of water reducer;
v. 175–320 pounds of water adjusted to provide a three-inch slump plus or minus one-half inch; and
vi. 11–21 ounces plasticizer adjusted to produce a slump factor of about 5.

3. The method of claim 1 wherein said dry shake dressing material contains a coloring agent and wherein sufficient dry shake dressing material thickness is applied to achieve a uniform color in said floor surface layer.

4. The method of claim 1 wherein said dry shake dressing material contains an amount of quartz crystals.

5. The method of claim 3 wherein said dry shake dressing material contains an amount of quartz crystals.

6. The method of claim 1 wherein the dry shake dressing material is applied and floated on said upper surface of said poured slab as a plurality of incremental amounts.

7. The method of claim 6 wherein said dry shake dressing material is applied in an initial amount of about 1.0 lb per square foot and thereafter in increments of about 0.5 lb per square foot.

8. The method of claim 5 wherein the dry shake dressing material is applied and floated on said upper surface of said poured slab as a plurality of incremental amounts.

9. The method of claim 8 wherein said dry shake dressing material is applied in an initial amount of about 1.0 lb per square foot and thereafter in increments of about 0.5 lb per square foot.

10. The method of claim 1 wherein step (i) includes mechanically finishing the surface to a predetermined smoothness using a plurality of progressively finer grit sanding devices.

11. The method of claim 1 wherein the compressive strength on the floor surface layer is at least 10,000 psi when fully cured.

12. The method of claim 8 wherein the compressive strength of said floor surface layer is at least 10,000 psi when fully cured.

13. The method of claim 9 wherein the mechanical reduction of surface roughness of step (i) includes sanding with a plurality of progressively finer grits.

14. The method of claim 1 wherein said expansion joints are sealed with an epoxy filler material.

15. The method of claim 2 wherein the specifically formulated design concrete mix comprises:

i. 517 pounds type one cement;
ii. 1400 pounds fine aggregate SSD;
iii. 1900 pounds gravel coarse aggregate number 8;
iv. 11 ounces of water reducer;
v. 247 pounds of water adjusted to provide a three-inch slump plus or minus one-half inch; and
vi. 16 ounces of plasticizer adjusted to provide a slump factor of about 5.

16. A method of fabricating a concrete floor having an autogenous polished surface comprising the steps of:

(a) pouring a specifically formulated design concrete mix containing coarse aggregate to establish a pour creating a slab of predetermined slab thickness having an upper surface at an upper surface distributed level slightly below a level determined for the finished floor;
(b) optionally mechanically rough finishing the upper surface to a desired texture;
(c) creating a floor surface layer on said upper surface of said slab by applying a first amount of dry shake dressing material having no coarse aggregate but containing an amount of quartz crystals and a coloring agent to said upper surface;
(d) floating said dry shake dressing material on said upper surface;
(e) adding an additional amount of dry shake dressing material;
(f) floating said upper surface again;
(g) repeating steps (e) and (f) until said floor surface layer is created on said upper surface having a predetermined amount of dry shake dressing material, such that said floor surface layer forms a generally monolithic floor with the concrete of said pour upon curing but which floor surface layer has a higher compressive strength than a compressive strength of said concrete of said pour when fully cured;
(h) optionally finishing the surface of said floor surface layer by hand to a smoothness suitable for curing;
(i) applying a water soluble sealer over the upper surface;
(j) cutting in any required expansion joints prior to curing said concrete;
(k) curing said concrete pour with said floor surface layer for approximately 30 days or until the concrete slab reaches about 4000 psi compressive strength;
(l) removing said sealer;
(m) smoothing the surface of said floor surface layer by mechanically applying progressively finer grit sanding; and
(n) polishing said surface of said floor surface layer until a desired level of shine in the polished surface is achieved for the floor.

17. The method of claim 16 wherein the specifically formulated design concrete mix comprises:

i. 360–675 pounds type one cement;
ii. 1000–1800 pounds fine aggregate SSD;
iii. 1300–2500 pounds gravel coarse aggregate number 8;
iv. 8–14 ounces of water reducer;
v. 175–320 pounds of water adjusted to provide a three-inch slump plus or minus one-half inch; and
vi. 11–21 ounces plasticizer adjusted to produce a slump factor of about 5.

18. The method of claim 17 wherein said floor surface layer has a fully cured compressive strength of at least 10000 psi.

19. The method of claim 17 wherein said first amount of dry shake dressing material is added as a quantity of about 1 lb per square foot and wherein said additional amounts are added in increments of about 0.5 lb per square foot.

20. The method of claim 19 wherein said floor surface layer has a fully cured compressive strength of at least 10000 psi.

21. A method of fabricating a concrete floor having a very hard, autogenous, high gloss surface finish comprising the steps of:

(a) pouring a specifically formulated design concrete mix containing coarse aggregate to establish a poured slab of a predetermined slab thickness having an upper surface and an upper surface distributed level slightly below a level determined for the finished floor;

(b) creating a floor surface layer on said upper surface of said slab by applying an amount of dry shake dressing material having no coarse aggregate, to said upper surface and floating said dry shake dressing material on said upper surface until a predetermined amount of dry shake material is applied, such that said floor surface layer forms a generally monolithic floor with the concrete of said slab upon curing but which floor surface layer has a higher compressive strength than a compressive strength of said concrete of said slab when fully cured;

(c) allowing said floor to cure approximately 30 days or until it reaches a predetermined compressive strength;

(d) mechanically reducing surface roughness of said floor by sanding said floor surface layer; and (e) polishing the surface of said floor surface layer until a final level of floor surface shine is achieved.

* * * * *